US007040841B2

(12) United States Patent
Kelm et al.

(10) Patent No.: US 7,040,841 B2
(45) Date of Patent: May 9, 2006

(54) SHALLOW WATER RISER SUPPORT

(75) Inventors: Ron L. Kelm, Houston, TX (US); Janet T. Leawood, Houston, TX (US); Peter A. Lunde, Cypress, TX (US)

(73) Assignee: Single Buoy Moorings, Inc., (CH)

( * ) Notice: Subject to any disclaimer, the term of this patent is extended or adjusted under 35 U.S.C. 154(b) by 0 days.

(21) Appl. No.: 10/617,986

(22) Filed: Jul. 10, 2003

(65) Prior Publication Data

US 2004/0028477 A1 Feb. 12, 2004

Related U.S. Application Data

(63) Continuation-in-part of application No. 10/348,414, filed on Jan. 21, 2003, now abandoned.

(60) Provisional application No. 60/352,751, filed on Jan. 30, 2002.

(51) Int. Cl.
*E21B 17/01* (2006.01)

(52) U.S. Cl. ..... 405/224.2; 405/169; 405/172; 405/224.3

(58) Field of Classification Search ..... 166/346, 166/347, 355; 405/169, 170, 172, 224.2, 405/224.3, 222.4
See application file for complete search history.

(56) References Cited

U.S. PATENT DOCUMENTS

| | | | | |
|---|---|---|---|---|
| 2,955,626 | A * | 10/1960 | Hartley | 405/172 |
| 3,722,223 | A | 3/1973 | Gratz | |
| 3,800,547 | A * | 4/1974 | Dutta et al. | 405/195.1 |
| 4,182,584 | A * | 1/1980 | Panicker et al. | 405/224.3 |
| 4,371,037 | A * | 2/1983 | Arnaudeau | 166/366 |
| 4,400,109 | A * | 8/1983 | Gentry et al. | 405/224.3 |
| 4,459,066 | A * | 7/1984 | van der Graaf | 405/224.3 |
| 4,661,016 | A * | 4/1987 | Baugh et al. | 405/169 |
| 4,793,737 | A * | 12/1988 | Shotbolt | 405/169 |
| 4,906,137 | A * | 3/1990 | Maloberti et al. | 405/224.3 |
| 5,427,046 | A | 6/1995 | Brown et al. | |
| 5,447,114 | A | 9/1995 | Korsgaard | |
| 5,480,264 | A | 1/1996 | Hunter | |

FOREIGN PATENT DOCUMENTS

| | | |
|---|---|---|
| GB | 2011506 A | 3/1979 |
| GB | 2244463 A | 12/1991 |

* cited by examiner

*Primary Examiner*—Frederick L. Lagman
(74) *Attorney, Agent, or Firm*—Leon D. Rosen

(57) ABSTRACT

A conduit structure (44) connects subsea oil wells to a floating structure (12) such as a vessel, in shallow water, the conduit structure providing a low cost and reliable fluid connection during drift of the vessel. The conduit structure includes a seafloor riser support (50) with a lower end (52) fixed to the seafloor and an upper end (54) lying a plurality of meters above the seafloor. A flexible pipe or hose (46) extends in a double catenary curve from the top of the seafloor riser support, at a downward incline away from the seafloor riser support and then at an upward incline to the floating structure. A rigid pipe (70) can extend along a plurality of meters of the height of the riser support to minimize the required length of flexible hose and facilitate installation.

7 Claims, 4 Drawing Sheets

10
12
14
16
18
20
22
24
26
30
32
32
42
44
46
50
52
54
56
60
62
64
92
94
95
96
98
A
B
M

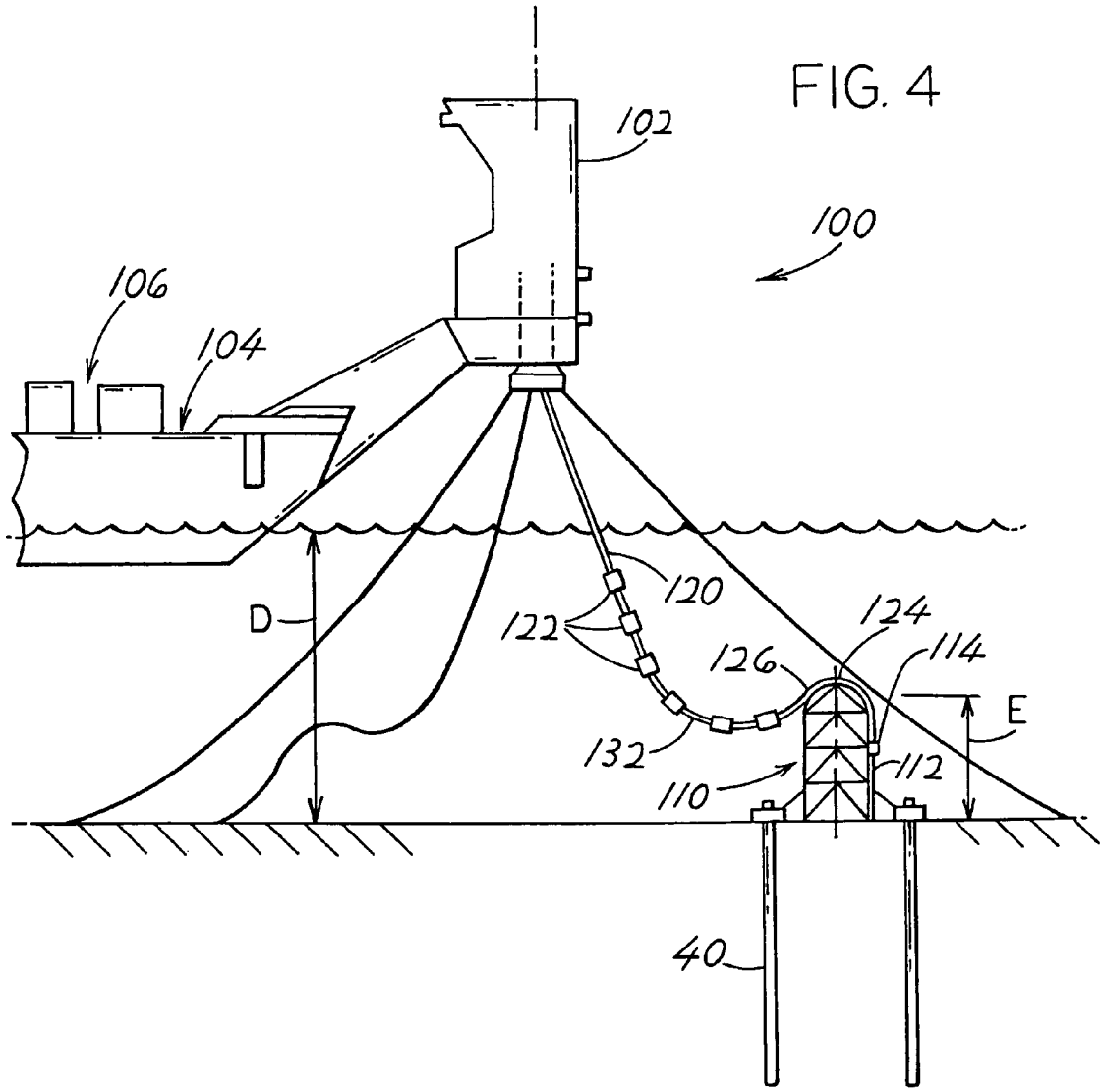
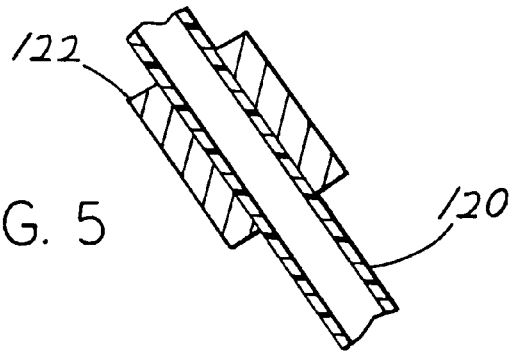
FIG. 5

SHALLOW WATER RISER SUPPORT

CROSS-REFERENCE TO RELATED APPLICATION

This is a continuation-in-part of U.S. application Ser. No. 10/348,414 filed Jan. 21, 2003, now abandoned, which claims priority from provisional application No. 60/352,751 filed Jan. 30, 2002.

BACKGROUND OF THE INVENTION

One type of system for producing hydrocarbons from undersea reservoirs of limited capacity, includes a floating structure such as a vessel anchored by catenary chains to the seafloor, or spread moored, or otherwise moored in a manner that allows limited vessel drift. Hydrocarbons from a seafloor well tapped into the reservoir, flow through conduits of a conduit structure, that extend up to the vessel to fill tanks in the vessel. Fluids such as injected gas may be pumped downward through a conduit back into the reservoir. Additional connections such as electrical and hydraulic connections may extend from the vessel to apparatus at the seafloor. The conduit structures must continue fluid connections between the vessel and seafloor well(s) despite drifting of the vessel within a limited drift zone. The conduits should not hit the mooring chains or the seafloor, since this can cause wear of a conduit.

One prior art conduit structure includes a first flexible hose that extends almost vertically up from the seafloor to an underwater buoy, and a second flexible hose that extends in a double catenary curve from the buoy to the vessel. In moderate to deep water (e.g. about 100 meters or more) the buoy lies high above the seafloor and the double catenary second hose provides a connection during vessel drift. However, a considerable length of hose is required, and flexible hose is expensive and not as reliable as a fixed pipe. In shallow water, any underwater buoy must lie close to the seafloor, resulting in appreciable cost for the buoy, for a heavy seafloor weight to moor the buoy, and for hose connections of a short first hose. In addition, a buoy at shallow depths moves sideward in heavy waves, in directions that may be counter to vessel movement, and the moveable parts limit the reliability of a buoy-based conduit system in shallow water. A fluid transfer system for transferring fluids between a seafloor structure and a floating structure in shallow water, which was of minimal cost while providing reliable connections during vessel drift, without a conduit beating against an anchor chain or the seafloor, would be of value.

SUMMARY OF THE INVENTION

In accordance with one embodiment of the present invention, an offshore fluid transfer system is provided, of the type wherein a conduit structure that includes a flexible pipe or hose, connects a seafloor structure such as an undersea reservoir to a floating structure such as a vessel, which minimizes the cost of the conduit structure in shallow waters. The conduit structure includes a rigid seafloor riser support with a lower end mounted on the seafloor and an upper end, and a flexible hose that extends from an upper portion of the seafloor riser support in a double catenary curve to the floating structure. A rigid pipe preferably extends a plurality of meters along the riser support. The seafloor riser support minimizes the cost of the lower portion of the conduit structure while increasing its reliability. The top of the riser support can be wide and have a convex upper surface, to allow the hose to be lifted off and placed back on the upper surface.

The riser support has a sufficient average horizontal width and horizontal length, compared to its height, that an underwater buoy is not required or used to support the top of the riser support. Such reliance on the strength of the rigid riser support, instead of a buoy, is made for a riser support that extends above the seafloor by more than 15%, and usually more than 20%, of the sea depth.

The novel features of the invention are set forth with particularity in the appended claims. The invention will be best understood from the following description when read in conjunction with the accompanying drawings.

BRIEF DESCRIPTION OF THE DRAWINGS

FIG. 4 is a partial side elevation view of a fluid transfer system of another embodiment of the invention, wherein a seafloor riser support has a convex upper surface and the flexible hose carries weights.

FIG. 5 is a sectional view of a portion of the conduit of FIG. 4.

DESCRIPTION OF THE PREFERRED EMBODIMENTS

Figure 1:
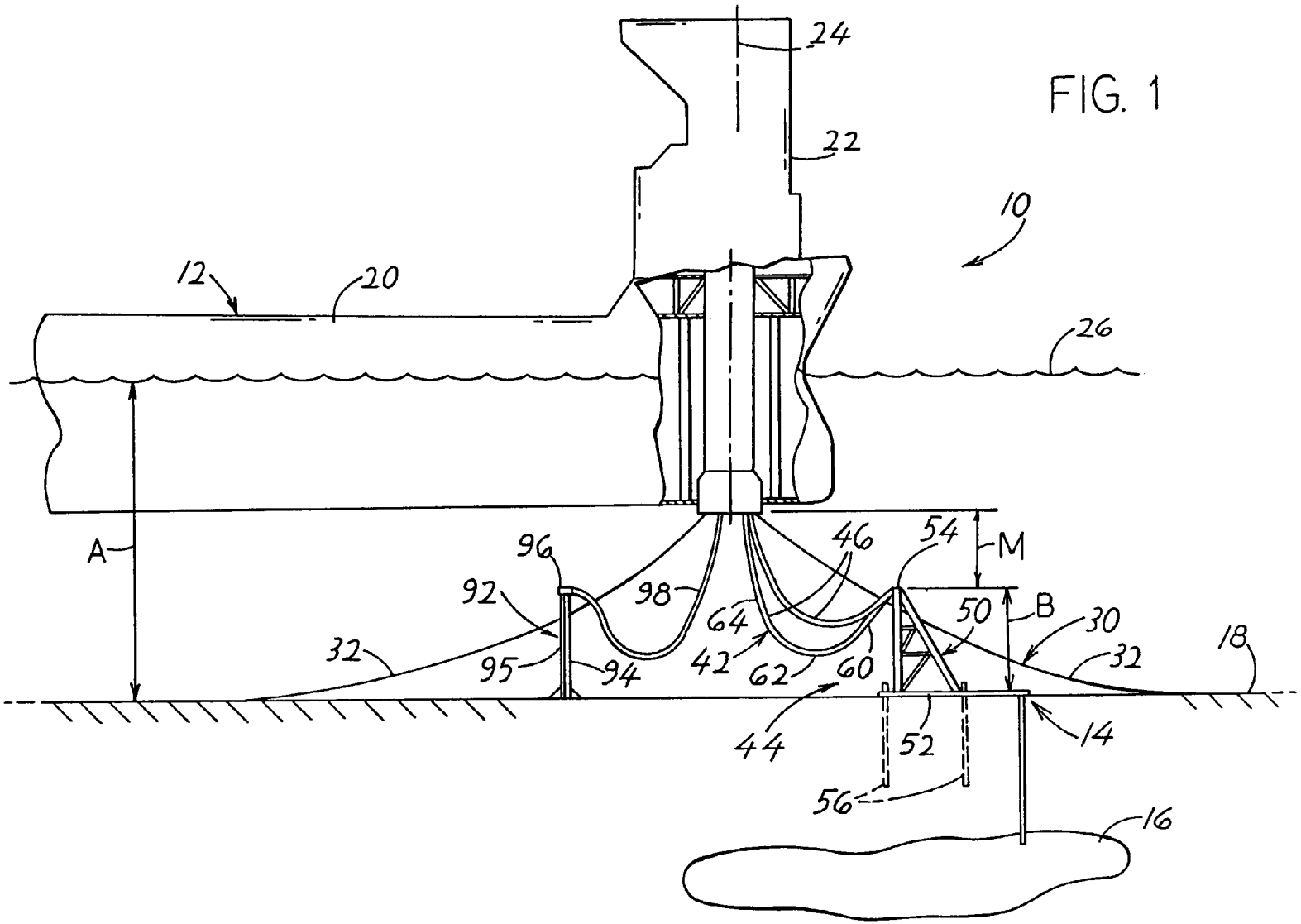
FIG. 1 is a side elevation view of a shallow water riser system of one embodiment of the present invention.

FIG. 1 illustrates an offshore fluid transfer system 10 that transfers fluids such as hydrocarbons, between a compliantly anchored floating structure 12 such as a vessel, and a seafloor structure 14. The seafloor structure 14 is connected to seafloor wells leading to an undersea reservoir 16, and is anchored to the seafloor 18. The vessel 12 includes a turret 22, and includes a hull 20 that is pivotable about a largely vertical axis 24 about the turret. The turret can lie within the hull or outward of the hull. The vessel, which floats at the sea surface 26, is moored through a mooring system 30 that includes a plurality of lines such as cables or chains 32 that extend in catenary curves to the seafloor 18 or that are always under tension. Other mooring systems can be used for a floating structure, such as a spread moored system that prevents weathervaneing (rotation) of the vessel so a turret is not required.

Fluid such as oil and gas from the undersea reservoir flows through conduits 42 of a conduit structure 44. The conduits include flexible risers 46 in the form of flexible pipes or hoses that may be referred to as flexible conduit members. It is noted that in some applications, fluids can flow between a pipeline on the seafloor and the vessel.

FIG. 1 shows the vessel 12 in a quiescent position, which it assumes in a calm sea. Under the forces of winds, waves and currents, the vessel can drift from its quiescent position. The drift zone within which the vessel can drift, is calculated for weather conditions existing at the particular location. During such vessel drift, the upper ends of the flexible risers, or hoses, follow the vessel while other portions of the flexible risers bend and translate.

The vessel lies in a shallow sea of height A which is generally no more than about 200 meters and usually no more than 100 meters. The conduit structure 44 is designed to allow the flexible risers 46 to follow the drifting vessel, in a conduit structure of simple construction, low maintenance, and low cost.

The conduit structure includes a substantially rigid seafloor riser support 50 whose lower end 52 is anchored to the seafloor and usually is rigidly fixed to the seafloor as by piles 56. The riser support 50 is a rigid frame that has an upper end 54 that lies a plurality of meters above the seafloor, preferably at least five meters and more preferably at least ten meters above the seafloor. The height B is at least 15% of the seafloor depth A, preferably at least 20% of the seafloor depth, and more preferably at least 30% of the seafloor depth. The vertical distance M' between the top of the riser support and the bottom of the loaded (80% of maximum load) vessel is preferably less than 50% of the sea depth A, so the riser support significantly reduces the length of flexible risers 46. The flexible risers 46 extend from the upper end 54 of the riser support in double catenary curves to the vessel 12. Applicant uses the term "double catenary curves" to indicate that one portion 60 of the flexible risers extend at a downward incline from the upper end 54 of the seafloor riser support to a lowermost point 62 along the risers (in the quiescent or static position of the vessel, which is illustrated), while another portion 64 of the risers extend at an upward incline from the point 62 to the vessel. Such double catenary curve is known to provide high flexibility.

Figure 2:
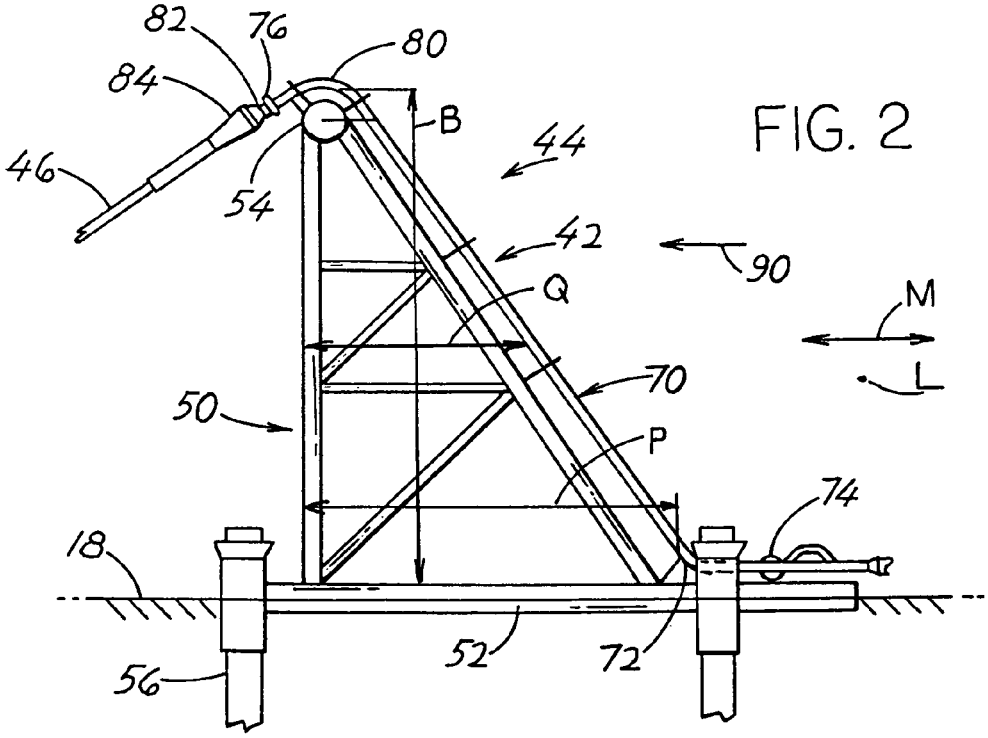
FIG. 2 is a side elevation view of a seafloor riser support of the system of FIG. 1.

FIG. 2 is a side elevation view of the riser support 50, which is rigid, whose lower end 52 is connected to the seafloor preferably in a fixed connection and whose upper end 54 lies a plurality of meters above the seafloor. The conduit 42 includes a rigid pipe 70 that is fixed at a plurality of locations spaced apart by a plurality of meters along the pipe, to the rigid support. The rigid pipe has a lower end 72 adjacent to the seafloor (preferably within about one meter of the seafloor). There may be additional pipe lengths 74 that extend along the seafloor away from the structure. The rigid pipe 70 has a far end 76 which is close to the top of the rigid pipe and which lies just beyond a curved rigid pipe section 80 that is preferably curved between 45° and 135° and that is illustrated as curved about a quarter of a circle (90°). This results in the pipe far end 76 extending at a downward incline away from the curved pipe section. As seen in FIG. 2, the rigid pipe 70 extends at an upward-forward (F) incline, while the flexible riser 46 extends at a downward-forward incline from the top of the riser support. The flexible riser 46 has an inner end 82 that is fixed to the far end 76 of the rigid pipe. A bend stiffener 84 that allows bending at only a large radius of curvature, may lie around the inner portion of the flexible riser 46 if required to control motion at this connection point. As mentioned above, the riser extends in a double catenary curve from its inner end at 82 to the vessel.

Figure 3:
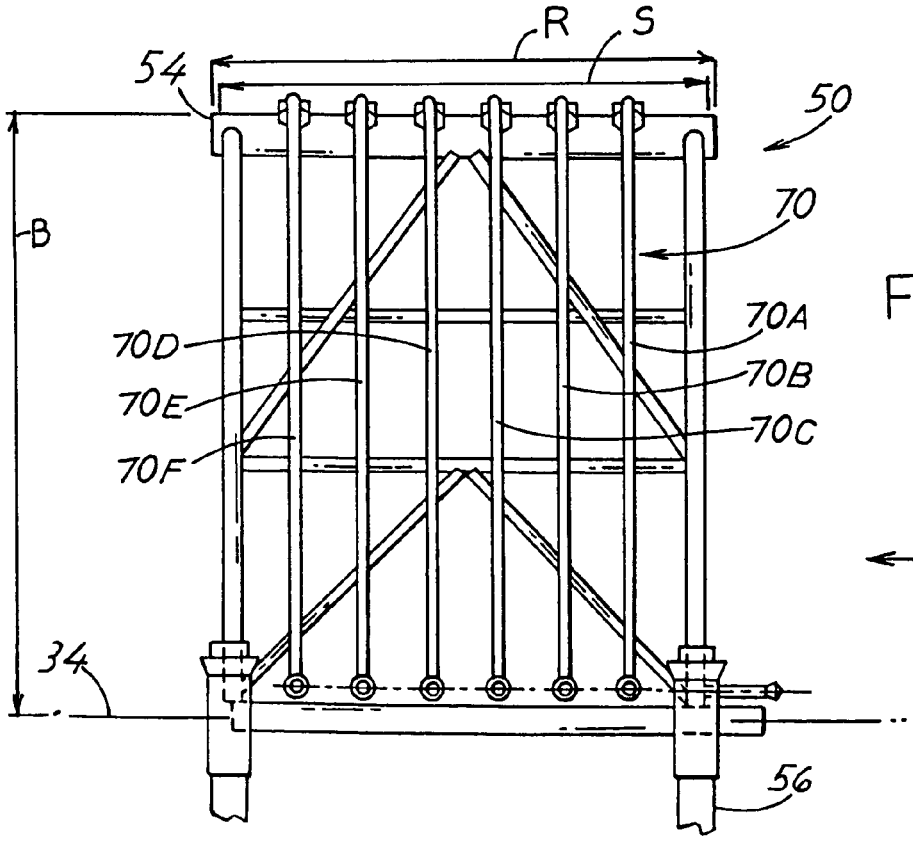
FIG. 3 is a rear elevation view taken along arrow 90 of FIG. 2.

FIG. 3, which is taken along arrow 90 in FIG. 2 which extends in a longitudinal direction M, shows that the seafloor riser support 50 includes a plurality of rigid pipes 70 labeled 70A–70F, with six rigid pipes being shown. The six rigid pipes are spaced apart in a lateral direction L. Each rigid pipe has a far end near the upper portion or end 54 of the structure, which is connected to a flexible riser, in the manner shown in FIG. 2, with all risers extending to the vessel.

In the particular system of FIG. 1, the sea has a depth A of thirty-six meters and the riser support 50 has a height B of fourteen meters above the seafloor 20, which is more than 25% (actually 39%) of the seafloor height. The upper end 54 of the structure is low enough to prevent it from being hit by the vessel even in a rough sea and in the fully loaded position of the vessel, or any other vessel that is likely to come into the vicinity of the vessel to which the conduit is connected. A tall seafloor riser support 50 provides reliable support for the lower conduit portion because the support moves very little if at all. The seafloor riser support is more reliable and of lower cost than a prior float based system in shallow water. Where the rigid pipe 42 extends along a plurality of meters of the seafloor riser support height, it replaces some of the required length of more expensive flexible risers 46 to further reduce costs. The higher the upper end 54 of the seafloor riser support, the greater the allowable length of the flexible riser 46 of FIG. 1 and therefore the greater the allowable vessel drift zone.

The rigid structure of the riser support has a greatest horizontal width P and average horizontal width Q (FIG. 2) and has a perpendicular greatest horizontal length R and average horizontal length S (FIG. 3), that are each at least 5% of the vertical height B, preferably at least 10% of the height, more preferably at least 15% of the height, and most preferably at least 20% of the height. The particular riser support 50 has an average width Q of 6 meters which is 42% of the height B. The considerable horizontal width and length results in a riser support that is rigid, rather than one that is flexible and requires a large buoy at the top and that can cause fatigue failure of a rigid pipe extending up along it. The riser support upper portion is devoid of attachment to an underwater buoy of significant volume to provide significant lift to the riser support upper portion.

Figure 6:
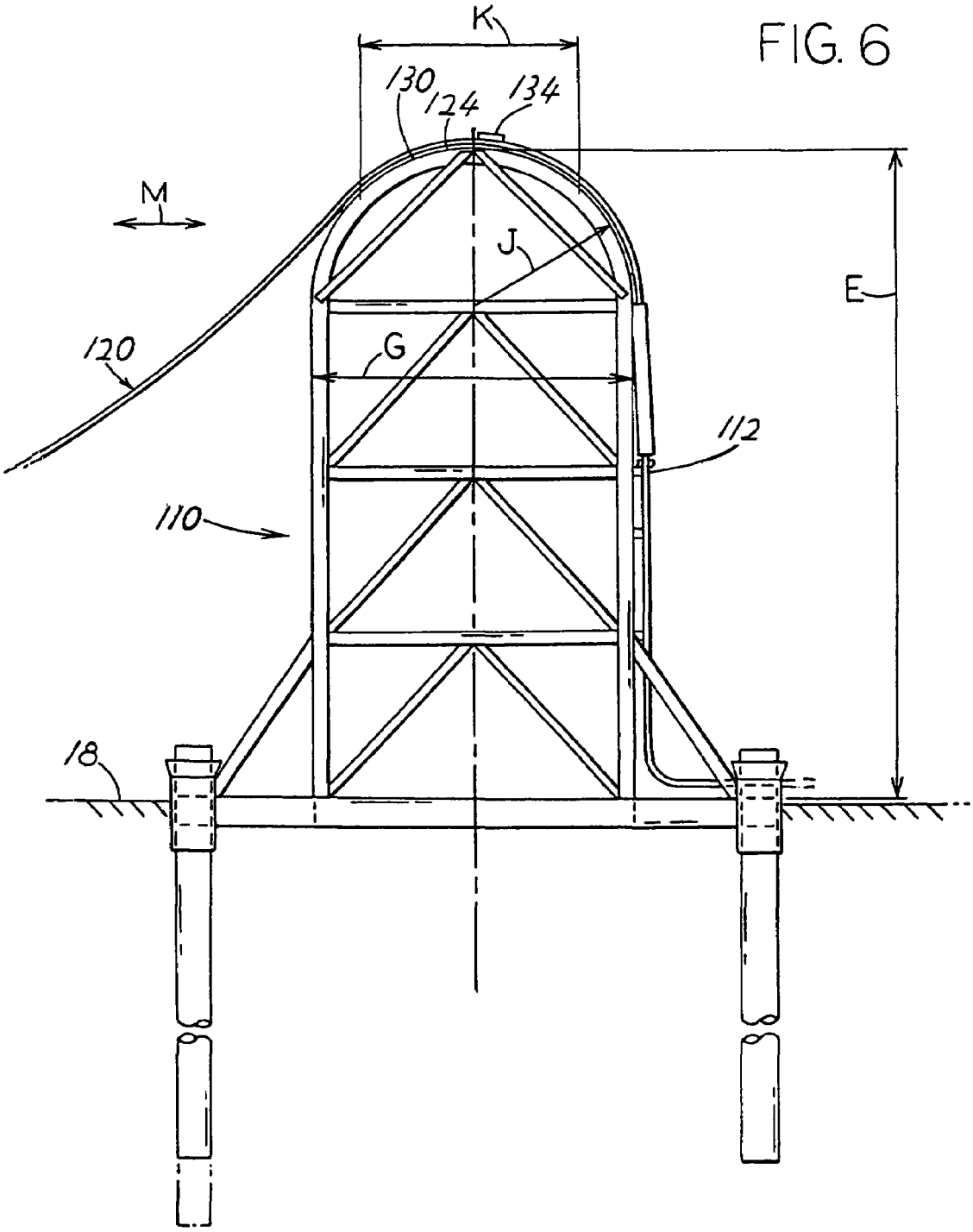
FIG. 6 is a side elevation view of the seafloor riser support of the system of FIG. 4.

The maximum buoyancy of an underwater buoy is roughly 80% of its external volume (times the density of water). The weight in water of a riser is roughly twice its volume (times the density of water) because the riser walls (steel) are dense but most of the riser is empty or contains hydrocarbons. The weight in water of a riser support consisting of solid (not hollow) beams as in FIG. 2 or 6, is about 6 times its external volume. A buoy does not apply significant buoyancy unless the buoy external volume is at least 25% of the weight in water of the riser support.

FIG. 1 shows an umbilical riser arrangement 92 for electrical signals, hydraulic fluid, etc. The arrangement includes a rigid post 94 with a lower end fixed to the seafloor, and rigid pipes 95 extending vertically along the post. Right angle elbows 96 at the top of the post connect to the umbilical risers 98. The flexible umbilical risers typically have a much smaller diameter than the diameter (e.g. 0.3 meters) of the flexible risers 46. The post 94 has an average width that is about 10% of its height above the sea floor.

The rigid post 94 is a variation of the seafloor riser support 50, and is especially useful for instances where a single flexible conduit is required. The seafloor riser support 50 also may be used for umbilical risers and the rigid post 94 that forms a simple seafloor riser support may be used for one or more risers.

It is noted that in the prior art, flexible hoses and umbilicals were used that extended from the seafloor up to an underwater buoy, and flexible hoses then extended from the flexible buoy in double catenary curves to a vessel. This is useful for deep seas. However, for a shallow sea of a height less than 100 meters, the undersea buoy cannot lie high above the seafloor, and the considerable expense for buoy connections of a short length of flexible hose to such buoy and to the seafloor would increase the cost and decrease reliability.

Rigid pipe such as 70 in FIG. 2 can be resiliently bent to only a very large radius of curvature such as five hundred times the outside diameter of the pipe for steel pipe, to assure that the pipe is bent only within in its elastic limits. Flexible pipes and hoses can elastically bend to a much smaller radius of curvature, depending upon the construction of the particular hose, but almost always can bend to a radius of curvature less than fifty times the hose outside diameter. The walls of the flexible pipe or hose comprise a costly structure to permit repeated resilient bending. The life of a flexible pipe or hose that is repeatedly bent, is short, and it may have to be replaced every few years.

FIG. 4 illustrates another fluid transfer system 100 wherein a turret 102 lies outboard of the hull 104 of a vessel 106. The system includes a seafloor riser support 110 that is rigid, that has a lower end mounted on the seafloor, and that holds rigid pipes 112 that extend upward from the seafloor. Connectors 114 connect ends of flexible risers (flexible pipes or hoses) 120 to the rigid pipes. The flexible risers extend in curves around the arched top 124 of the seafloor riser support, and then extend in double catenary curves from point 126 to the turret 102 of the vessel. Applicant mounts weight modules 122 to the flexible riser 120 at locations spaced along the length of the flexible riser. The weight modules, which may be formed of steel, undergo less acceleration and less motion during severe storms. The weight modules may be used with any flexible riser portion.

Waves apply large forces to the vessel and to the risers in storms. The fact that the seafloor riser support and the flexible risers ends at 124 do not move with the waves, avoids a situation where the vessel and lower end of the riser move in opposite directions during a storm.

The sea depth D in FIG. 4 is forty-eight meters and the seafloor riser support 110 extends up from the seafloor by a distance E of twenty meters, which is sufficient to be sure that the fully loaded vessel 106 and other vessels that come to the vicinity of the reservoir do not strike the structure 110. The seafloor riser support height E is over 30% (actually 42%) of the sea depth D.

FIG. 6 shows that the flexible riser 120 has a portion 130 that extends over the arched top 124 of the seafloor riser support 110. A length K of the upper surface 126 of the riser faces primarily upwardly and has a length K of over one meter and preferably a plurality of meters. The flexible riser can lift off and fall back onto this and adjacent portions of the riser top. When the vessel drifts far away from the riser support (but within the drift zone), the riser portion 130 can lift off the arch and later fall back onto the arch. The risers may be biased back to their illustrated quiescent position. The radius of curvature J of the arched top is preferably at least five times the diameter of the flexible pipe or hose (about 0.3 meters) and preferably more than one meter and more preferably a plurality of meters. The longitudinal M length G of the arched top is a plurality of meters, the arched top in FIG. 6 having a length G of 9.5 meters and a radius of curvature J of 4.7 meters. The horizontal width G of 9.5 meters is over one-third the height E of 20 meters. The horizontal length of the riser support is about the same or greater than that of the width.

It is noted that FIG. 4 shows a system where the bottom of the double catenary curve 132 lies considerably above the seafloor in the quiescent condition (calm seas). In FIG. 4, the height E of the seafloor riser support can be reduced to about half the height shown (21% of the sea depth).

The fluid transfer systems of FIGS. 1-6 result in several advantages over prior systems, especially in shallow water. The seafloor riser support 50, 110 of the conduit structure is fixed to the seafloor so its upper end 54 is fixed in position with respect to the seafloor. This fixes the end of the double catenary curve of the flexible riser opposite the vessel, high above the seafloor, using a reliable and low cost structure. The rigid pipes preferably extend a plurality of meters along the height of the structure and are not repeatedly bent. The system avoids or reduces the need for distributed buoyancy modules, and avoids the need for an underwater buoy and for flexible risers that extend up from the seafloor to such a buoy or flexible pipe that is repeatedly bent.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An offshore fluid transfer system which includes a fluid-passing seafloor structure such as one connected to a seafloor well or pipeline, a compliantly anchored floating structure such as a vessel, that floats at the sea surface, at least one mooring line that is anchored to the seafloor and that holds said floating structure in the vicinity of said seafloor structure and at an initial position in a calm environment, and a fluid-carrying conduit structure that extends up from said seafloor structure to said floating structure, wherein:

said conduit structure includes a single rigid seafloor riser support that has a lower portion lying at the seafloor and fixed in position and orientation to the sea floor, said riser support also has an upper portion lying at a height of at least 10 meters above the sea floor and at least 20% of the height of the sea above the seafloor but less than the height of the sea so the upper portion of the support lies in the sea to reduce the required length of flexible conduit;

said conduit structure also includes a supported pipe that extends along a plurality of meters of the height of said riser support and that is fixed to said riser support at a plurality of locations that are vertically spaced apart by a plurality of meters, and said conduit structure includes a flexible conduit portion that extends from said seafloor riser support to said floating structure.

2. The system described in claim 1 wherein:

said upper portion of said riser support lies at a height above the seafloor of at least 30% of the height of the sea.

3. The system described in claim 1 wherein:

said supported pipe is straight and rigid.

4. The system described in claim 1 wherein:

said supported pipe extends straight along a height of a plurality of meters at a forward upward incline up to the top portion of said riser support, and said flexible conduit portion extends at a forward-downward incline from the top portion of said riser support.

5. The system described in claim 1 wherein:

said rigid frame has a longitudinal (M) length and a lateral (L) width, and said transfer system includes a plurality of supported rigid pipe lengths, including said supported pipe, which are laterally (L) spaced apart and that each extends along a plurality of meter of height of said riser support.

6. An offshore fluid transfer system which includes a fluid-passing seafloor structure such as one connected to a seafloor well or pipeline, a compliantly anchored floating structure such as a vessel, at least one mooring line that is anchored to the seafloor and that holds said floating structure in the vicinity of said seafloor structure and at an initial position in a calm environment, and a fluid-carrying conduit structure that extends up from said seafloor structure to said floating structure, wherein:

said conduit structure includes a single rigid seafloor riser support that has a lower portion lying at the seafloor and an upper portion lying at a height of a plurality of meters above the seafloor;

said conduit structure also includes a supported pipe that extends along a plurality of meters of the height of said riser support and that is fixed to said riser support at a plurality of locations that are vertically spaced apart by a plurality of meters, and said conduit structure includes a flexible conduit portion that extends from said seafloor riser support to said floating structure;

said seafloor riser support upper portion forms a convexly rounded hose-supporting top surface that has a radius of curvature of a plurality of meters, and said conduit flexible portion includes a part that extends around said top surface and that can lift off said top surface and lay back down on said top surface.

7. An offshore fluid transfer system which includes a fluid-passing seafloor structure such as one connected to a seafloor well or pipeline, a compliantly anchored floating structure such as a vessel, at least one mooring line that is anchored to the seafloor and that holds said floating structure in the vicinity of said seafloor structure and at an initial position in a calm environment, and a fluid-carrying conduit structure that extends up from said seafloor structure to said floating structure, wherein:

said conduit structure includes a single rigid seafloor riser support that has a lower portion lying at and fixed in position and orientation to the seafloor and an upper portion fixed in position and orientation to said sea floor and lying at a height of at least ten meters above the seafloor but less than the height of the sea so the upper portion of the support lies in the sea;

said conduit structure also includes a supported rigid pipe that extends along a plurality of meters of the height of said riser support and that is fixed to said riser support at a plurality of locations that are vertically spaced apart by a plurality of meters, and said conduit structure includes a flexible conduit portion that extends from said seafloor riser support to said floating structure;

said riser support has sufficient average horizontal width and length dimensions compared to its height, that said riser supports the conduit structure without an underwater buoy to pull up the top of the riser support;

said supported pipe extends at a forward upward incline to the top portion of said riser support, and said flexible conduit portion extends at a forward-downward incline from the top portion of said riser support;

said riser upper portion lies at a height of at least 30% of the height of the sea at the riser support.

* * * * *